US010472937B2

(12) United States Patent
Walters et al.

(10) Patent No.: US 10,472,937 B2
(45) Date of Patent: Nov. 12, 2019

(54) ASSEMBLY FOR WELLBORE PERFORATION

(71) Applicant: Halliburton Energy Services, Inc., Houston, TX (US)

(72) Inventors: Darren Philip Walters, Tomball, TX (US); Stuart Michael Wood, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 2 days.

(21) Appl. No.: 15/767,612

(22) PCT Filed: Apr. 6, 2017

(86) PCT No.: PCT/US2017/026411
§ 371 (c)(1),
(2) Date: Apr. 11, 2018

(87) PCT Pub. No.: WO2018/186870
PCT Pub. Date: Oct. 11, 2018

(65) Prior Publication Data
US 2019/0063197 A1 Feb. 28, 2019

(51) Int. Cl.
*E21B 43/117* (2006.01)
*E21B 43/119* (2006.01)

(52) U.S. Cl.
CPC ..... *E21B 43/117* (2013.01); *E21B 43/119* (2013.01)

(58) Field of Classification Search
CPC ..... E21B 43/117; E21B 43/119
See application file for complete search history.

(56) References Cited

U.S. PATENT DOCUMENTS

| | | | |
|---|---|---|---|
| 4,523,649 | A | 6/1985 | Stout |
| 4,753,170 | A | 6/1988 | Regalbuto et al. |
| 5,295,544 | A | 3/1994 | Umphries |
| 5,347,929 | A | 9/1994 | Lerche et al. |
| 5,673,760 | A | 10/1997 | Brooks et al. |
| 6,167,957 | B1 | 1/2001 | Frazier |
| 6,962,202 | B2 | 11/2005 | Bell et al. |
| 7,413,015 | B2 | 8/2008 | McKinnon et al. |
| 7,861,784 | B2 | 1/2011 | Burleson et al. |
| 8,443,886 | B2 | 5/2013 | Torres et al. |
| 2008/0149338 | A1 | 6/2008 | Goodman et al. |
| 2012/0247771 | A1 | 10/2012 | Black et al. |
| 2014/0000894 | A1 | 1/2014 | Coffey et al. |
| 2015/0361774 | A1* | 12/2015 | Flores ..... E21B 43/117 166/297 |

FOREIGN PATENT DOCUMENTS

WO 2015134565 A1 9/2015

OTHER PUBLICATIONS

International Search Report and Written Opinion dated Jan. 15, 2018; International PCT Application No. PCT/US2017/026411.

* cited by examiner

*Primary Examiner* — Kristyn A Hall
(74) *Attorney, Agent, or Firm* — McGuireWoods LLP

(57) ABSTRACT

The disclosed embodiments include a perforating gun assembly. The perforating gun assembly includes an uphole plate and a downhole plate. Additionally, the perforating gun assembly includes a plurality of perforation guns coupled to the uphole plate and the downhole plate. The plurality of perforation guns have a plurality of charges that in operation punch holes in a casing within a wellbore.

19 Claims, 6 Drawing Sheets

900
912
1002
902

116
210

702
802

106
903
904
906
907
908
910
914
916

ASSEMBLY FOR WELLBORE PERFORATION

BACKGROUND

The present disclosure relates generally to downhole perforation guns used within a well, and more specifically to a system including multiple perforation guns to perforate a large diameter casing within the well.

When abandoning a well, it is desirable to cement plugs in place to close zones of the well and stop migration of fluids. To cement the plugs in place, a perforating gun is used to punch a production casing. Punches in the production casing enable an annular space between casings (e.g., a first casing and a second casing) to be filled with a cement slurry.

However, when punching a casing with a large diameter, such as a casing near a surface of the well, either a large diameter perforation gun is used or a small diameter perforation gun is used several times. The large diameter perforation gun may be an impractical solution based on cost and weight. Further, the small diameter perforation gun may provide inconsistent hole size and a lack of penetration based on varying distances of the charges to a wall of the casing. Further, the small diameter perforation gun may be inefficient as multiple punches around a perimeter of the casing are used to achieve a desired casing perforation to cement the plugs in place.

BRIEF DESCRIPTION OF THE DRAWINGS

Illustrative embodiments of the present disclosure are described in detail below with reference to the attached drawing figures, which are incorporated by reference herein, and wherein.

Figure 1:
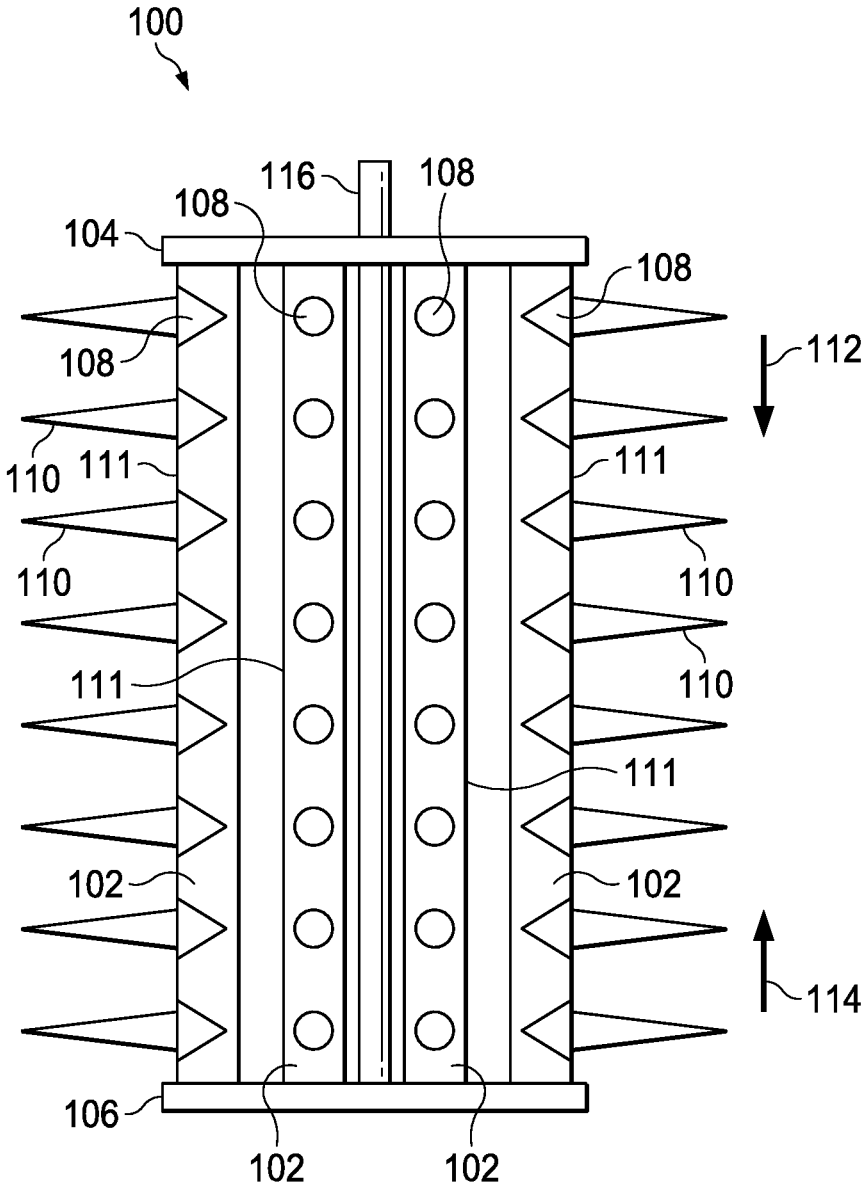
FIG. 1 is a schematic view of a perforating gun assembly.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the disclosed subject matter, and it is understood that other embodiments may be utilized and that logical structural, mechanical, electrical, and chemical changes may be made without departing from the spirit or scope of the disclosure. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

The present disclosure relates to a perforating gun that punches holes in a casing at a downhole location. More particularly, the present disclosure relates to an assembly that combines several individual perforating guns to simultaneously punch holes at several locations along a circumference of the casing. The presently disclosed embodiments may be used in horizontal, vertical, deviated, or otherwise nonlinear wellbores in any type of subterranean formation. Embodiments may be implemented to install a cement plug within a wellbore in a well abandonment or an abandonment of a zone within the well. Further, embodiments may be implemented in other wellbore operations, such as in completions operations to perforate the casing prior to production.

Referring to FIG. 1, a schematic illustration of a perforating gun assembly 100 is provided. The perforating gun assembly 100 includes a plurality of perforation guns 102 coupled between an uphole plate 104 and a downhole plate 106. The plurality of perforation guns 102 each provide a plurality of charges 108 that are zero degrees phased from one another that are aimed radially outward from the perforating gun assembly 100. The charges 108 include a small amount of high explosive that is shaped to produce a pressure punch 110 capable of punching holes in a casing within a well. In an embodiment, the pressure punch 110 is capable of punching holes in steel, cement, rock formations, or any other surfaces that the pressure punch 110 may come in contact with in a downhole well. Each of the perforation guns 102 includes a housing 111 that provides structural support to the perforating gun assembly 100. Further, the housing 111 houses detonating cord within the perforation guns 102 used to detonate the charges 108.

The perforation guns 102 are removable from the perforating gun assembly 110, and may be used individually within smaller diameter casings within a well. Further, the perforation guns 102 within the perforating gun assembly 100 may be fired in a top down manner, as indicated by arrow 112, or in a bottom up manner, as indicated by arrow 114. Top fire (e.g., in the direction of the arrow 112) of a perforation gun 102 is used to have a detonation wave move from the uphole plate 104 to the downhole plate 106 of perforation gun 102. This configuration reduces wire feed through in the gun assembly 100. The top fire configuration also reduces the ability to select fire a section of the perforation gun 102 when multiple sections of the perforation gun 102 are stacked. Bottom firing of the perforation gun 102, for example, allows the ability to select fire each section of the perforation gun 102 in an order moving from a furthest downhole section of the perforation gun 102 to the most uphole section of the perforation gun 102 on command. The detonation wave will move from the downhole plate 106 of the perforation gun 102 to uphole plate of the perforation gun 102. Bottom firing may also enable a fluid disable detonator (not shown) to function properly within the perforation gun 102. When the fluid disable detonator is used, flooding of the fluid disable detonator placed at or near the downhole plate 106 of the gun system 100 would cause the fluid disable detonator to become disabled from fluid and prevent the perforation gun 102 from firing while fluid is at the perforation gun 102. Firing the perforation gun 102 while fluid is present may result in a low order detonation or damage to the gun system 100 and or a well in which the gun system 100 is placed.

In a top down firing of the perforating gun assembly 100, detonating cord and detonating cord boosters may be positioned within the uphole plate 104, as discussed in detail below with reference to FIG. 5. In a bottom up firing of the perforating gun assembly 100, a signal cord may extend through a weight bar 116 to provide firing signals to the detonating cord and detonating cord boosters within the downhole plate 106, as discussed in detail below with reference to FIG. 9. The weight bar 116 may also be used to provide added stability between the uphole plate 104 and the downhole plate 106, and to add weight to the perforating gun assembly 100 to aid in running the perforating gun assembly 100 to a desired depth within a well. In an embodiment, added weight from the weight bar 116 helps the perforating gun assembly 100 overcome effects of pressure and friction acting on the perforating gun assembly 100 as the perforating gun assembly 100 is lowered into position within the well. In a top down firing embodiment, the weight bar 116 may not be included in the perforating gun assembly 100.

The perforating gun assembly 100 is configured to enable efficient punching of a large casing (e.g., a first string) without affecting a casing behind the large casing (e.g., a second string). Further, the perforating gun assembly 100 may also be capable of punching holes through multiple casings. The punches in the large casing produced by the perforating gun assembly 100 are sufficiently large to provide an adequate flow area for cement slurry to exit the large casing during a well or zone abandonment. The uphole plate 104 and the downhole plate 106 may vary in size such that the charges 108 of the perforation guns 102 are disposed close to a wall of the casing at the firing location. For example, when the casing has a diameter of 18 inches, the uphole plate 104 and the downhole plate 106 may have diameters of approximately 16 inches. Alternatively, when the casing has a diameter of 16 inches, the uphole plate 104 and the downhole plate 106 may have diameters of approximately 14 inches. These sizes are used as examples only, and other diameters of the casing and the uphole and downhole plates 104 and 106 are also contemplated.

Additionally, a number of perforation guns 102 positioned about an edge of the uphole and downhole plates 104 and 106 may change based on a diameter of the casing. The depicted perforating gun assembly 100 includes an arrangement of six of the perforation guns 102. As illustrated, two of the perforation guns 102 are positioned directly behind the middle perforation guns 102, and, thus, are not shown in FIG. 1. In another embodiment, the perforating gun assembly 100 may include more or fewer perforation guns 102 depending on a diameter of the casing to be punched, a flow area requirement for the cement, a size of the individual perforation gun 102, a diameter of the uphole and downhole plates 104 and 106, or any combination thereof.

Figure 2:
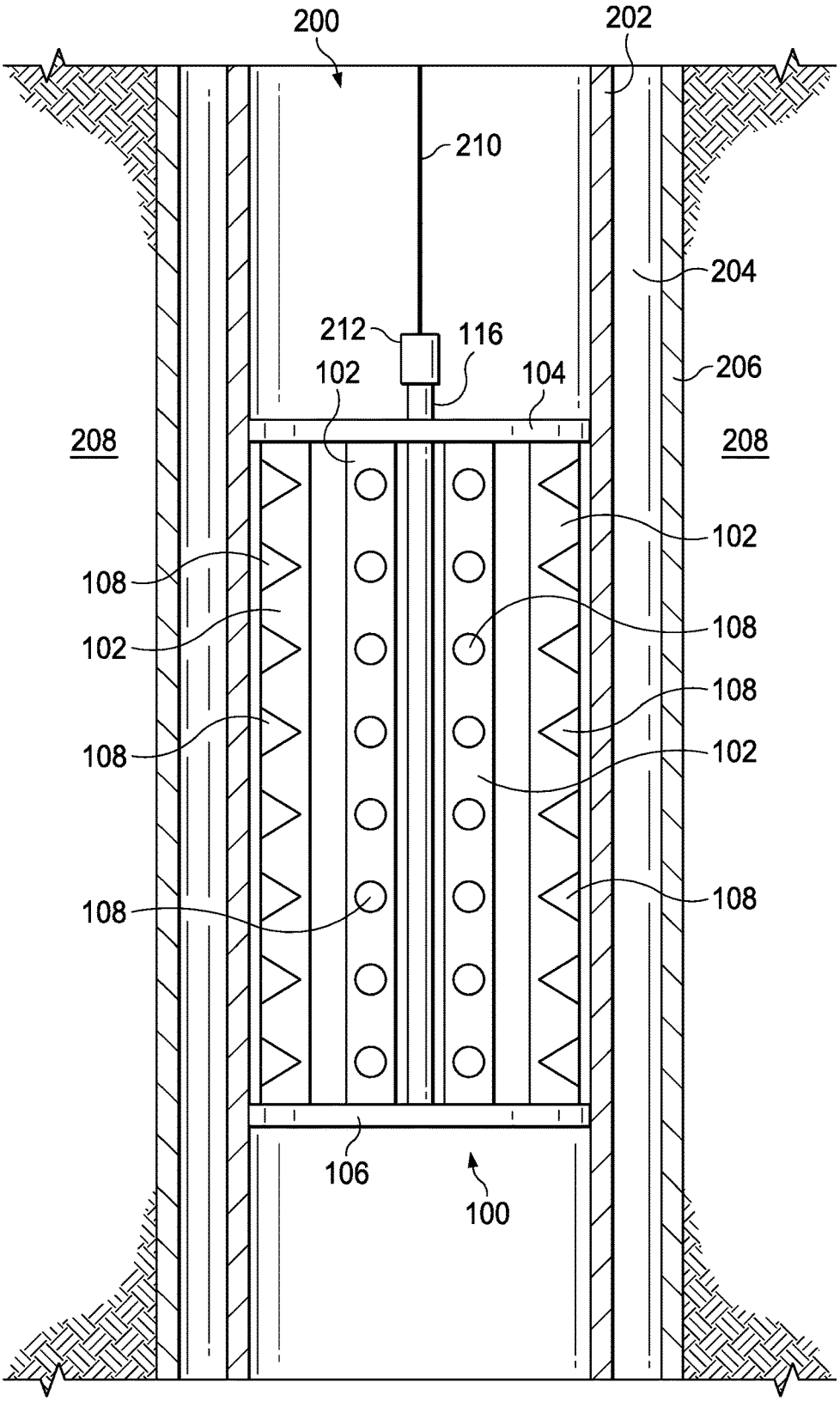
FIG. 2 a schematic view of the perforating gun assembly of FIG. 1 within a wellbore.

FIG. 2 is a schematic view of the perforating gun assembly 100 within a wellbore 200. The perforating gun assembly 100 is positioned within a production casing 202. In an embodiment, the charges 108 of the perforating gun assembly 100 are positioned in close proximity with the production casing 202 such that the charges 108 punch holes in the production casing 202. An annular space 204 is provided between the production casing 202 and a protection casing 206. The positioning of the charges 108 in relation to the production casing 202 may be such that when the charges 108 punch through the production casing 202, the protection casing 206 remains undamaged. For example, by placing the charges 108 in close proximity to the production casing 202, the pressure punch 110 may be focused on the production casing 202 in such a manner that collateral damage to the protection casing 206 is avoided. As used herein, the term "close proximity" means that the charges 108 are positioned closer to the production casing 202 than ten percent of a diameter of the production casing 202.

The perforating gun assembly 100 may be fed into the wellbore 200 using a wireline 210. In some embodiments, the wireline 210 may be replaced with a slickline or conveyed by pipe. In an embodiment, the wireline 210 provides a signal to an uphole sub 212 coupled to the perforating gun assembly 100. The uphole sub 212 may include a detonator sub (not shown) that detonates the detonating cord within the uphole plate 104 when the perforating gun assembly 100 is fired from the top down. In a bottom up firing embodiment of the perforating gun assembly 100, the wireline 210 runs through the uphole sub 212 and the weight bar 116 to a detonator sub, as described below with reference to FIG. 9, positioned within the downhole plate 106. The detonator sub within the downhole plate 106 may receive a detonation signal from the wireline 210 and detonate the detonating cord within the downhole plate 106 when the perforating gun assembly 100 is fired. The detonating cord in either embodiment detonates the charges 108 of the perforation guns 102 to punch the production casing 202 while avoiding damage to the protection casing 206.

Figure 3:
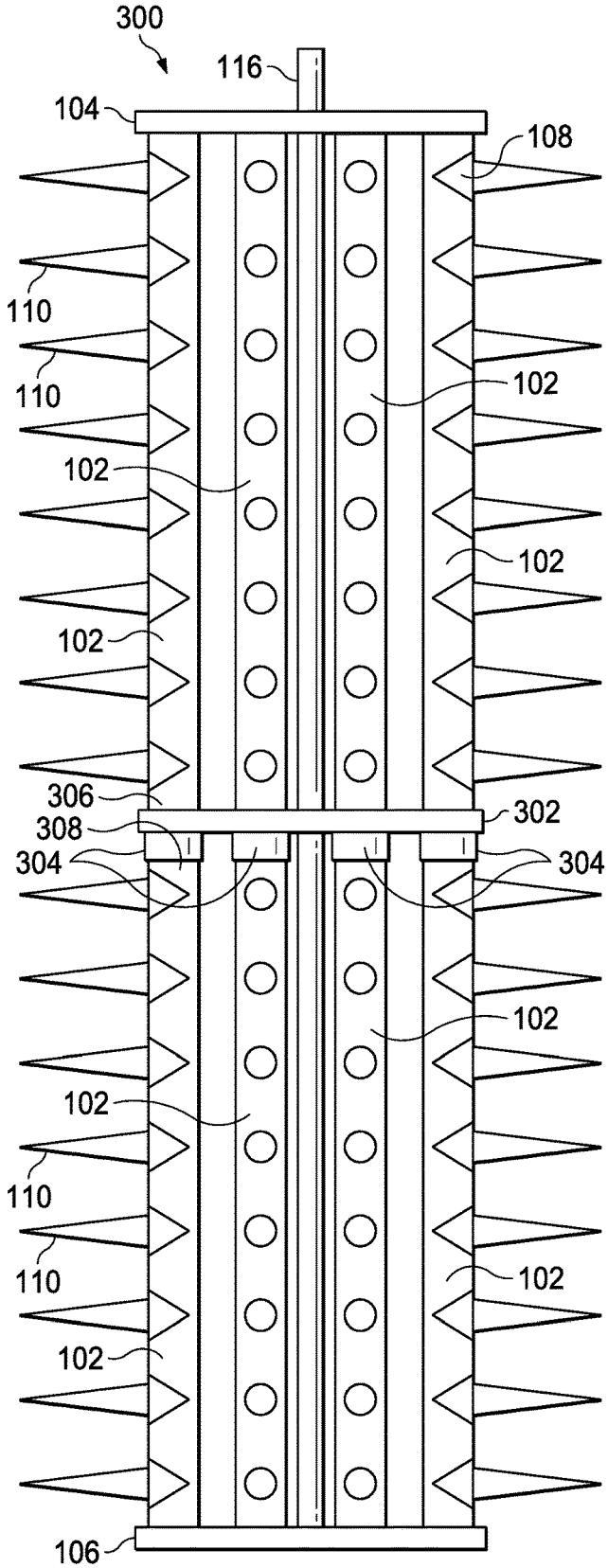
FIG. 3 is a schematic view of an extended perforating gun assembly.

Referring to FIG. 3, a schematic view of an extended or modular perforating gun assembly 300 is depicted. In an embodiment, the extended perforating gun assembly 300 is similar to the perforating gun assembly 100 with an additional set of perforation guns 102 and an interconnecting plate 302 coupled between the sets of perforation guns 102. As illustrated, the two sets of perforation guns 102 couple with each other using gun tandems 304 that are coupled to the interconnecting plate 302. The gun tandems 304 function to couple perforation guns 102 together at an end 306 of one perforation gun 102 to an end 308 of another perforation gun 102. Further, the gun tandems 304 couple detonating cord at the end 306 of one perforation gun 102 to detonating cord at the end 308 of another perforation gun 102. In the illustrated embodiment, the detonating cord at the end 306 detonates a detonating cord booster within the gun tandem 304, and the detonating cord booster within the gun tandem 304 provides a detonating charge to the detonating cord at the end 308.

In another embodiment, the gun tandems 304 are separate from the interconnecting plate 302. In such an embodiment, the gun tandems 304 couple to the perforation guns 102, and the interconnecting plate 302 rests atop the gun tandems 304. In both the embodiment with integral gun tandems 304 on the interconnecting plate 302 and the embodiment with the gun tandems 304 separate from the interconnecting plate 302, the interconnecting plate 302 provides the extended perforating gun assembly 300 added structural stability. For example, the interconnecting plate 302 prevents bowing of the perforation guns 102 at the gun tandems 304 during firing of the charges 108.

The extended perforating gun assembly 300 may be used in a similar manner as the perforating gun assembly 100 with the extended perforating gun assembly 300 providing additional punch holes into the production casing 202. In an embodiment, additional sets of the perforation guns 102 may be added to the extended perforating gun assembly 300 along with an additional interconnecting plate 302 and a set of gun tandems 304 to extend a length of the extended perforating gun assembly 300. Accordingly, the extended perforating gun assembly 300 may cover as much surface area of the production casing 202 as an operator may desire in a single punch operation. Further, in an embodiment, the weight bar 116 extends an entire length of the extended perforating gun assembly 300 between the uphole plate 104 and the downhole plate 106.

Figure 4:
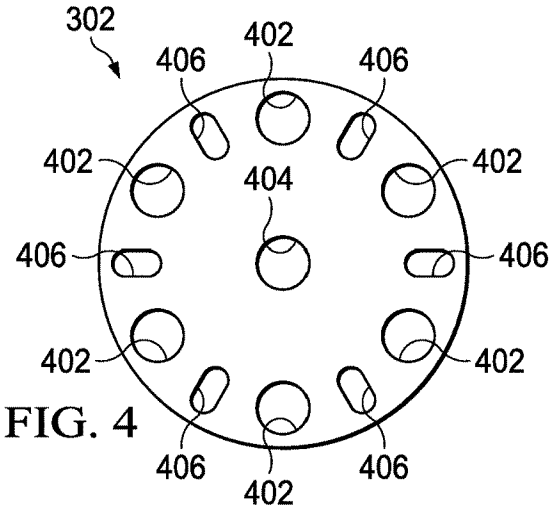
FIG. 4 is a top view of an interconnecting plate of the extended perforating gun assembly of FIG. 3.

FIG. 4 is a top view of the interconnecting plate 302 of the extended perforating gun assembly 300. The interconnecting plate 302 includes a set of through holes 402. Each of the through holes 402 is shaped to receive the ends 306 of the perforation guns 102. Additionally, the through holes 402 are positioned along an outer circumference of the interconnecting plate 302. By positioning the through holes 402 near an outer circumference of the interconnecting plate 302, the charges 108 of the perforation guns 102 are positioned in close proximity to the production casing 202 within the wellbore 200.

Also depicted is a through hole 404 that receives the weight bar 116. While the through hole 404 is depicted with generally the same diameter as the through holes 402, it may be appreciated that the through hole 404 may be larger or smaller than the through holes 402 depending on a diameter of the weight bar 116. In an embodiment, the through holes 402, which receive the perforation guns 102, are all generally the same size and shape, as the perforation guns 102 are interchangeable within the extended perforating gun system 300. However, in another embodiment, it is contemplated that one or more of the through holes 402 may be larger or smaller than the remainder of the through holes 402. For example, if a larger charge 108 is desired along one of the perforation guns 102, the perforation gun 102 may have a larger diameter than the perforation guns 102 with the smaller charges 108. Accordingly, the through hole 402 that receives the perforation gun 102 with the larger diameter may also have a larger diameter than the other through holes 402.

Also included in the interconnecting plate 302 is a plurality of fluid holes 406 positioned between the through holes 402. The fluid holes 406, in operation, allow fluid within the wellbore 200 to flow through the interconnecting plate 302. By enabling the fluid to flow through the fluid holes 406, less force is used on the extended perforating gun assembly 300 to drop the perforating gun assembly 300 to the desired depth within the wellbore 200. For example, because fluid flows through the fluid holes 406 while the extended perforating gun assembly 300 travels downhole within the wellbore 200, pressure buildup on a downhole side of the interconnecting plate 302 is reduced. The reduction in pressure buildup enables the extended perforating gun assembly 300 to travel downhole within the wellbore 200 with greater efficiency than when an interconnecting plate 302 is employed without the fluid holes 406.

Figure 5:
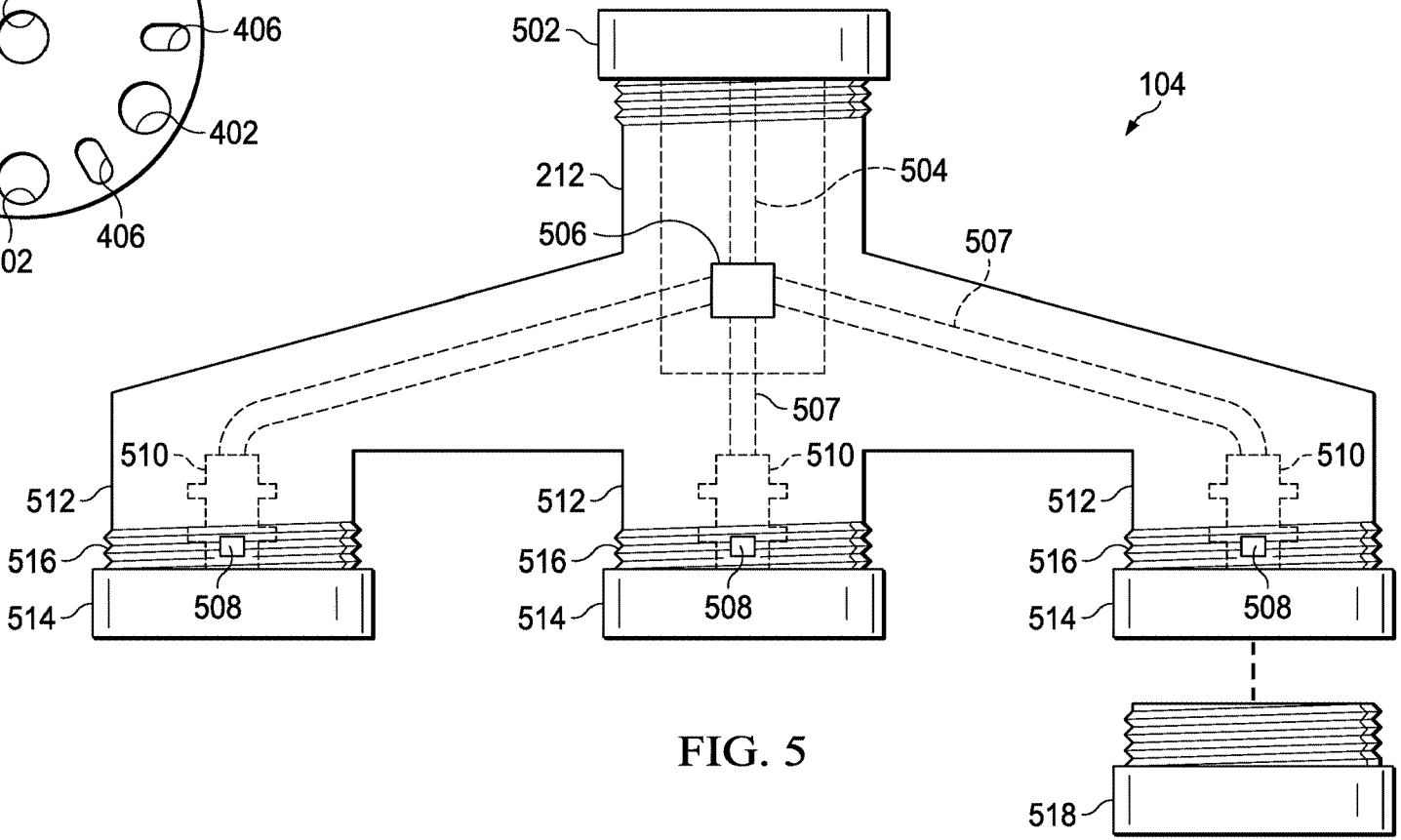
FIG. 5 is a cross-sectional view of an uphole plate of the perforating gun assembly of FIG. 1.

FIG. 5 is a cross-sectional view of the uphole plate 104 of the perforating gun assembly 100 or the extended perforating gun assembly 300. As mentioned above with reference to FIG. 2, the uphole plate 104 includes a top sub 212. In an embodiment, the uphole sub 212 couples to the wireline 210 to position the perforating gun assembly 100 within the wellbore 200 and to communicate with the perforating gun assembly 100 from a surface of the wellbore 200. Additionally, the uphole sub 212 may include a detonator sub 502. The detonator sub 502 receives a fire signal from the surface and detonates the detonating cord 504 extending from the detonator sub 502.

After the detonating cord 504 extending from the detonator sub 502 is detonated, a booster 506, which is also coupled to the detonating cord 504, is detonated. Because several detonating cords 507 extend from the booster 506 toward the perforation guns 102, the booster 506 provides sufficient power to detonate all of the detonating cords 507 simultaneously. Further, each of the detonating cords 507 is coupled to a booster 508, which provides a detonating force to detonate detonating cords within the perforation guns 102.

The detonating cord 507 and the boosters 508 are placed within a polymer alignment insert (PAI) 510. In an embodiment, the PAI 510 ensures that the boosters 508 and the detonating cord 507 are centered within legs 512 of the uphole plate 104 that lead to the perforation guns 102. By centering the boosters 508 and the detonating cord 507, the uphole plate 104 provides a precise connection point for the detonating cord within the perforation guns 102.

Also illustrated are locking rings 514 that couple to threads 516 of the legs 512. The locking rings 514 fit around the perforation guns 102 and couple the perforation guns 102 to the legs 512 when the locking rings 514 couple to the threads 512. The locking rings 514 also allow the perforation guns 102 to be positioned as desired and locked in place for deployment downhole. Further, the locking rings 514 enable secure contact between the boosters 508 and the detonating cord of the perforation guns 102 when the perforation guns 102 are secured to the legs 512.

In an embodiment, the perforating gun assembly 100 may not use as many perforation guns 102 as the uphole plate 104 is capable of holding. In such an embodiment, a threaded cap 518 couples to the leg 512 that does not receive a perforation gun 102. The threaded cap 518 is a pressure cap that blanks off an opening of the perforating gun assembly 100 at the leg 512 that does not receive the perforation gun 102. By blanking off the opening at the leg 512 that does not receive the perforation gun 102, ingress of wellbore fluid that would flood the perforating gun assembly 100 is avoided.

Figure 6:
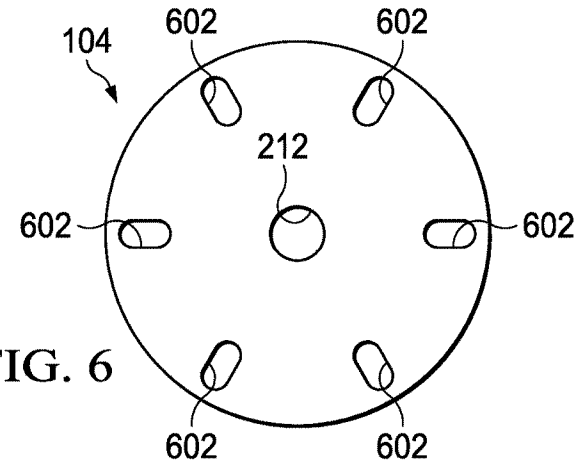
FIG. 6 is a top view of the uphole plate of FIG. 5.

To further illustrate the structure of the uphole plate 104, FIG. 6 is a top view of the uphole plate 104. The uphole plate 104 includes the uphole sub 212 that couples to the wireline 210. Additionally, the uphole plate 104 includes fluid holes 602 that allow fluid within the wellbore 200 to pass through the uphole plate 104. The fluid holes 602 may be a similar size and shape as the fluid holes 406 of the interconnecting plate 302. Further, in an embodiment, the fluid holes 602 are located vertically in-line with the fluid holes 406 of the interconnecting plate 302 when the uphole plate 104 is used for the extended perforating gun assembly 300.

By allowing the fluid to flow through the fluid holes 602, less force is used on the perforating gun assembly 100 or the extended perforating gun assembly 300 to drop the perforating gun assembly 100/300 to a desired depth within the wellbore 200. For example, because fluid flows through the fluid holes 602 while the perforating gun assembly 100/300 travels downhole in the wellbore 200, pressure buildup on a downhole side of the uphole plate 104 is reduced. The reduction in pressure buildup enables the perforating gun assembly 100/300 to travel downhole within the wellbore 200 with increased efficiency than when an uphole plate 104 is employed without the fluid holes 602.

Additionally, in some embodiments, the uphole sub 212 is designed to receive the weight bar 116 on a side of the uphole plate 104 opposite the detonator sub 502 (e.g., the detonator gun side of the uphole plate 104). Further, in another embodiment, the weight bar 116 may be completely removed from the top down firing configuration of the uphole plate 104 depicted in FIG. 5. For example, the weight bar 116 may generally be used in an embodiment of the perforating gun assembly 100/300 with a bottom up firing configuration, as discussed in detail below with reference to FIG. 9. Accordingly, when an additional weight on the perforating gun assembly 100/300 with a top down firing configuration that is provided by the weight bar 116 does not assist in placing the perforating gun assembly 100/300 at a desired position within the wellbore 200, the weight bar 116 may not be used as a portion of the perforating gun assembly 100/300.

Figure 7:
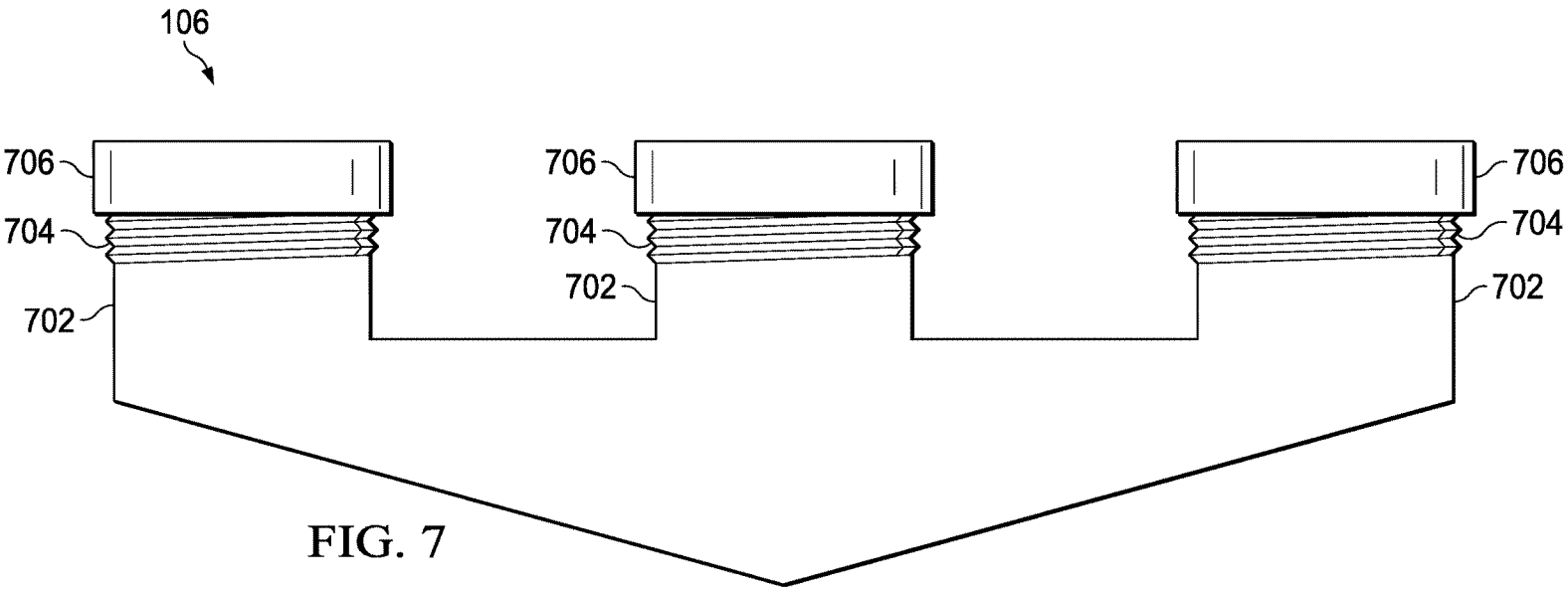
FIG. 7 is a side view of a downhole plate of the perforating gun assembly of FIG. 1.

FIG. 7 is a side view of the downhole plate 106 of the perforating gun assembly 100 or the extended perforating gun assembly 300 when the perforating gun assembly 100/300 fires in a top down configuration. Because the perforating gun assembly 100/300 is in a top down configuration, the downhole plate 106 does not include any detonating cord or boosters to detonate the perforation guns 102. The downhole plate 106 includes legs 702 that receive the perforation guns 102 when the perforating gun assembly 100/300 is assembled. The legs 702 include threads 704 that interact with locking rings 706 in a similar manner to the threads 516 and the locking rings 514 of the uphole plate 104.

By coupling the perforation guns 102 to the downhole plate 106, the perforation guns 102 are secured closer to a wall of the wellbore 200. For example, without the downhole plate 106, force from the charges 108 may drive downhole portions of the perforation guns 102 away from the wall of the wellbore 200. By coupling the downhole portions of the perforation guns 102 to the downhole plate 106, the downhole portions of the perforation guns 102 remain at intended positions with respect to the wall of the wellbore 200.

Figures 8, 9, 10:
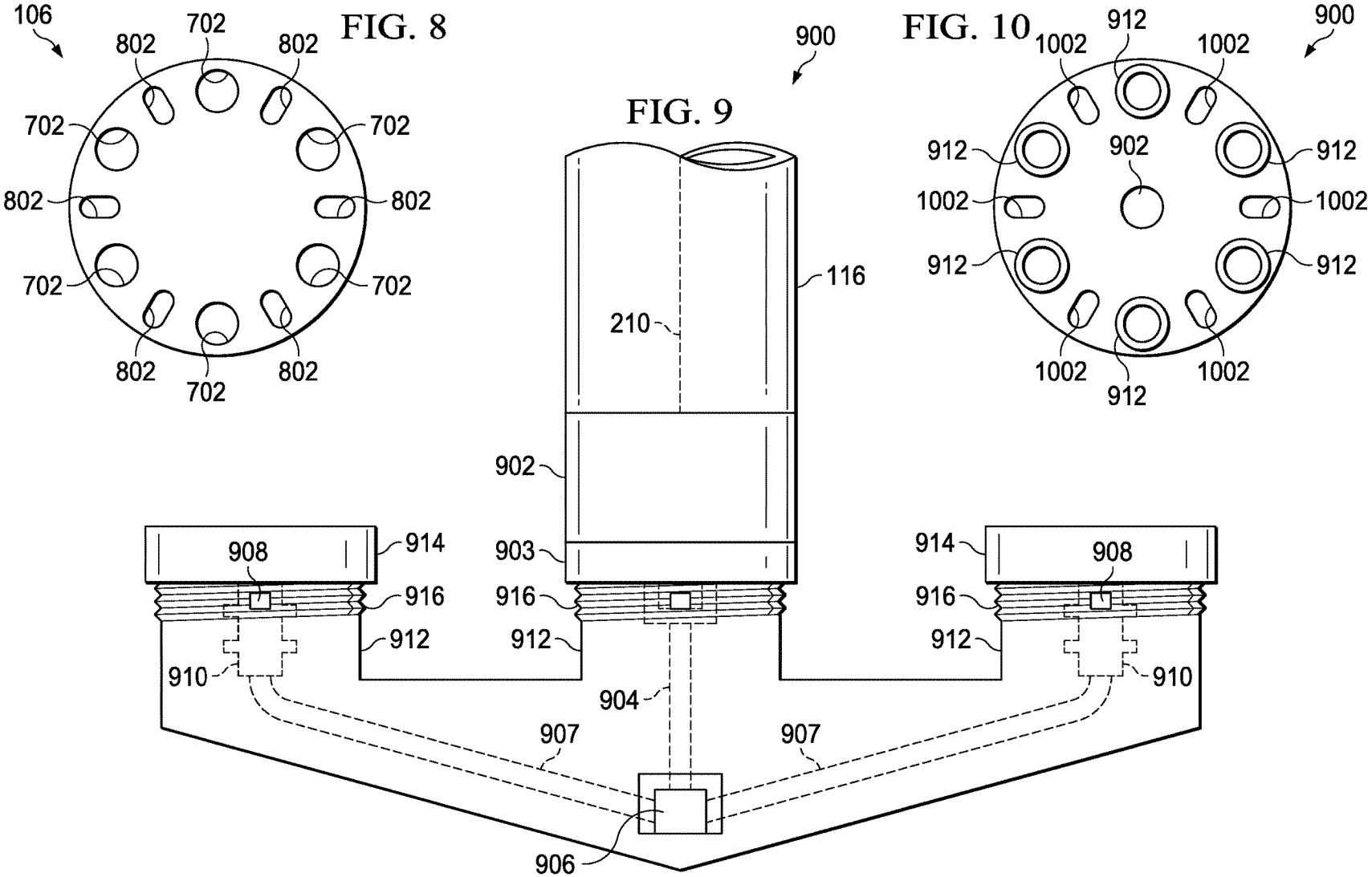
FIG. 8 is a top view of the downhole plate of FIG. 7.
FIG. 9 is a cross-sectional view of a downhole plate of a downhole fire perforating gun assembly.
FIG. 10 is a top view of the downhole plate of FIG. 9.

To further illustrate the structure of the downhole plate 106, FIG. 8 is a top view of the downhole plate 106. The downhole plate 106 includes the legs 702 that couple to the perforation guns 102. Additionally, the downhole plate 106 includes fluid holes 802 that allow fluid within the wellbore 200 to pass through the downhole plate 106. The fluid holes 802 may be a similar size and shape as the fluid holes 406 and 602 of the interconnecting plate 302 and the uphole plate 104, respectively. Further, in an embodiment, the fluid holes 802 are located vertically in-line with the fluid holes 406 and 602 of the interconnecting plate 302 and the uphole plate 104, respectively, when the downhole plate 106 is used for the extended perforating gun assembly 300. Additionally, the fluid holes 802 are located vertically in-line with the fluid holes 602 of the uphole plate 104 when the downhole plate 106 is used for the perforating gun assembly 100. It may be appreciated that the size, shape, and relative location of the fluid holes 406, 602, and 802, in some embodiments, may also be different from each other.

By allowing the fluid to flow through the fluid holes 802, less force is used on the perforating gun assembly 100 or the extended perforating gun assembly 300 to drop the perforating gun assembly 100/300 to a desired depth within the wellbore 200. For example, because fluid flows through the fluid holes 802 while the perforating gun assembly 100/300 travels downhole within the wellbore 200, pressure buildup on a downhole side of the downhole plate 106 is reduced. The reduction in pressure buildup enables the perforating gun assembly 100/300 to travel downhole within the wellbore 200 with increased efficiency than when a downhole plate 106 is employed without the fluid holes 802.

FIG. 9 is a cross-sectional view of a downhole plate 900 of the perforating gun assembly 100 or the extended perforating gun assembly 300 in a bottom up firing arrangement. The downhole plate includes a downhole sub 902 that couples to the wireline 210 running through the weight bar 116. The wireline 210 positions the perforating gun assembly 100 within the wellbore 200 and communicates with the perforating gun assembly 100 via the downhole sub 902 from a surface of the wellbore 200. Additionally, the downhole sub 902 may couple to a detonator sub 903. The detonator sub 903 receives a fire signal from the surface via the wireline 210 and the downhole sub 902 and detonates detonating cord 904 extending from the detonator sub 903.

After the detonating cord 904 extending from the detonator sub 903 is detonated, a booster 906, which is coupled to the detonating cord 904, is detonated. Because several detonating cords 907 extend from the booster 906 toward the perforation guns 102, the booster 906 provides sufficient power to detonate all of the detonating cords 907 simultaneously. Further, each of the detonating cords 907 is coupled to a booster 908, which provides a detonating force to detonate detonating cords within the perforation guns 102.

The detonating cord 907 and the boosters 908 are placed within a polymer alignment insert (PAI) 910. In an embodiment, the PAI 910 ensures that the boosters 908 and the detonating cord 907 are centered within legs 912 of the downhole plate 900 that lead to the perforation guns 102. By centering the boosters 908 and the detonating cord 907, the downhole plate 900 provides a precise connection point for the detonating cord within the perforation guns 102.

Also illustrated are locking rings 914 that couple to threads 916 of the legs 912. The locking rings 914 fit around the perforation guns 102 and couple the perforation guns 102 to the legs 912 when the locking rings 914 couple to the threads 912. The locking rings 914 also allow the perforation guns 102 to be positioned as desired and locked in place for deployment downhole. Further, the locking rings 914 enable secure contact between the boosters 908 and the detonating cord of the perforation guns 102 when the perforation guns 102 are secured to the legs 912. Additionally, a threaded cap 518, as described with reference to FIG. 5, may be secured to the legs 912 when the perforating gun assembly 100 does not use as many perforation guns 102 as the downhole plate 900 is capable of holding.

When the perforating gun assembly 100 or 300 uses a bottom up firing configuration, as described with reference to FIG. 9, the uphole plate 104 may be replaced with the interconnecting plate 302 on an uphole portion of the perforation guns 102 to maintain the perforation guns 102 in a desired position relative to the downhole plate 900. Further, in the extended perforating gun assembly 300, multiple interconnecting plates 302 may be used. For example, in an embodiment, an interconnecting plate 302 is positioned at a joint between two sets of the perforation guns 102, and another interconnecting plate 302 is positioned on an uphole portion of the uphole set of the perforation guns 102.

To further illustrate the structure of the downhole plate 900, FIG. 10 is a top view of the downhole plate 900. The downhole plate 900 includes the legs 912 that couple to the perforation guns 102. The downhole plate 900 also includes the downhole sub 902 that couples to the weight bar 116, the wireline 210, and the detonator sub 903. Additionally, fluid holes 1002 are positioned on the downhole plate 900 that allow fluid within the wellbore 200 to pass through the downhole plate 900. The fluid holes 1002 may be a similar size and shape as the fluid holes 406 and 602 of the interconnecting plate 302 and the uphole plate 104, respectively. Further, in an embodiment, the fluid holes 1002 are located vertically in-line with the fluid holes 406 and 602 of the interconnecting plate 302 and the uphole plate 104, respectively, when the downhole plate 900 is used for the extended perforating gun assembly 300. In an embodiment, the fluid holes 1002 are located in-line with the fluid holes 602 of the uphole plate 104 when the downhole plate 900 is used for the perforating gun assembly 100. It may be appreciated that the size, shape, and relative location of the fluid holes 406, 602, and 1002, in some embodiments, may also be different from each other.

By allowing the fluid to flow through the fluid holes 1002, less force is used on the perforating gun assembly 100 or the extended perforating gun assembly 300 to drop the perforating gun assembly 100/300 to a desired depth within the wellbore 200. For example, because fluid flows through the fluid holes 1002 while the perforating gun assembly 100/300 travels downhole within the wellbore 200, pressure buildup on a downhole side of the downhole plate 900 is reduced. The reduction in pressure buildup enables the perforating gun assembly 100/300 to travel downhole within the wellbore 200 with increased efficiency than when a downhole plate 900 is employed without the fluid holes 1002.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a perforating gun assembly, comprising: an uphole plate; a downhole plate; and a plurality of perforation guns coupled to the uphole plate and the downhole plate, wherein the plurality of perforation guns comprise a plurality of charges configured to punch holes in a casing within a wellbore.

Clause 2, the assembly of clause 1, wherein the uphole plate comprises a detonator that is configured to detonate the charges of the plurality of perforation guns.

Clause 3, the assembly of clause 1, comprising: a weight bar extending from the uphole plate to the downhole plate; and a detonator disposed within the downhole plate, the detonator configured to detonate the charges of the plurality of perforation guns.

Clause 4, the assembly of at least one of clauses 1-3, wherein the uphole plate and the downhole plate each comprise at least one fluid hole configured to allow fluid within the wellbore to pass through the uphole plate and the downhole plate.

Clause 5, the assembly of at least one of clauses 1-4, wherein the plurality of charges are arranged along each of the plurality of perforation guns zero degrees phased from one another.

Clause 6, the assembly of at least one of clauses 1-5, wherein the plurality of charges are aimed radially outward from the perforating gun assembly.

Clause 7, the assembly of at least one of clauses 1-6, wherein the plurality of charges are configured to punch holes in the casing without damaging a second casing positioned within the wellbore around the casing.

Clause 8, the assembly of at least one of clauses 1-7, wherein each of the plurality of perforation guns are removable from the perforating gun assembly, and wherein the perforating gun assembly is operable with one of the plurality of perforation guns removed from the perforating gun assembly.

Clause 9, the assembly of at least one of clauses 1-8, wherein diameters of the uphole plate and the downhole plate are sixteen inches.

Clause 10, the assembly of at least one of clauses 1-9, wherein the plurality of perforation guns comprises at least six perforation guns.

Clause 11, a perforating gun assembly, comprising: an uphole plate; a downhole plate; an interconnecting plate; a first plurality of perforation guns coupled to the uphole plate and the interconnecting plate, wherein the first plurality of perforation guns comprise a first plurality of charges configured to punch holes in a casing within a wellbore; and a second plurality of perforation guns coupled to the interconnecting plate and the downhole plate, wherein the second plurality of perforation guns comprise a second plurality of charges configured to punch holes in the casing within the wellbore.

Clause 12, the assembly of clause 11, wherein the interconnecting plate comprises a plurality of gun tandems configured to couple the first plurality of perforation guns to the second plurality of perforation guns.

Clause 13, the assembly of clause 11 or 12, wherein the interconnecting plate comprises a set of through holes configured to receive the first plurality of perforation guns and the second plurality of perforation guns.

Clause 14, the assembly of at least one of clauses 11-13, wherein the uphole plate, the downhole plate, and the interconnecting plate each comprise at least on fluid hole configured to allow fluid within the wellbore to pass through the uphole plate, the downhole plate, and the interconnecting plate, and the at least one fluid hole of each of the uphole plate, the downhole plate, and the interconnecting plate aligns with each other in a vertical orientation.

Clause 15, the assembly of at least one of clauses 11-14, wherein each perforation gun of the first plurality of perforation guns and the second plurality of perforation guns are removable from the perforating gun assembly and interchangeable with each other.

Clause 16, the assembly of at least one of clauses 11-15, wherein each perforation gun of the first plurality of perforation guns and the second plurality of perforation guns comprises a housing configured to house a detonator cord of the perforation gun.

Clause 17, a perforating gun assembly, comprising: an uphole plate; a downhole plate; and a plurality of perforation guns coupled to the uphole plate and the downhole plate, wherein each of the plurality of perforation guns comprises:

a plurality of charges configured to punch holes in a casing within a wellbore; and a housing configured to structurally support the perforating gun assembly and to house detonating cord within the perforator gun.

Clause 18, the assembly of clause 17, wherein the uphole plate comprises a detonator configured to detonate the charges of the plurality of perforation guns upon detonation, and the uphole plate is configured to receive a detonate signal from a wireline that instructs the detonator to detonate.

Clause 19, the assembly of clause 17 or 18, wherein the uphole plate comprises: a plurality of legs configured to receive the plurality of perforation guns; and a plurality of polymer alignment inserts, each of the plurality of polymer alignment inserts disposed within one of the plurality of legs and configured to orient a detonating cord within the uphole plate and a booster within the uphole plate with the detonating cord within one of the plurality of perforation guns.

Clause 20, the assembly of at least one of clauses 17-19, wherein each of the plurality of perforation guns is removable from the perforating gun assembly, and wherein, when one perforation gun of the plurality of perforation guns is removed from the perforating gun assembly, the perforating gun assembly comprises a threaded cap coupled to a leg of the uphole plate that is not filled by the one perforator gun.

While this specification provides specific details related to certain components related to a perforating gun assembly, it may be appreciated that the list of components is illustrative only and is not intended to be exhaustive or limited to the forms disclosed. Other components related to perforating casings within a wellbore will be apparent to those of ordinary skill in the art without departing from the scope and spirit of the disclosure. Further, the scope of the claims is intended to broadly cover the disclosed components and any such components that are apparent to those of ordinary skill in the art.

It should be apparent from the foregoing disclosure of illustrative embodiments that significant advantages have been provided. The illustrative embodiments are not limited solely to the descriptions and illustrations included herein and are instead capable of various changes and modifications without departing from the spirit of the disclosure.

What is claimed is:

1. A perforating gun assembly, comprising:
an uphole plate;
a downhole plate; and
a plurality of perforation guns coupled to the uphole plate and the downhole plate;
wherein each of the plurality of perforation guns is removable from the perforating gun assembly, and wherein, when one perforation gun of the plurality of perforation guns is removed from the perforating gun assembly, the perforating gun assembly comprises a pressure cap coupled to a leg of the uphole plate that is not filled by the one perforator gun.

2. The assembly of claim 1, wherein the uphole plate comprises a detonator that is configured to detonate the charges of the plurality of perforation guns.

3. The assembly of claim 1, comprising:
a weight bar extending from the uphole plate to the downhole plate; and
a detonator disposed within the downhole plate, the detonator configured to detonate the charges of the plurality of perforation guns.

4. The assembly of claim 1, wherein the uphole plate and the downhole plate each comprise at least one fluid hole configured to allow fluid within the wellbore to pass through the uphole plate and the downhole plate.

5. The assembly of claim 1, wherein the plurality of charges are arranged along each of the plurality of perforation guns zero degrees phased from one another.

6. The assembly of claim 1, wherein the plurality of charges are aimed radially outward from the perforating gun assembly.

7. The assembly of claim 1, wherein the plurality of charges are configured to punch holes in the casing without damaging a second casing positioned within the wellbore around the casing.

8. The assembly of claim 1, wherein each of the plurality of perforation guns are removable from the perforating gun assembly, and wherein the perforating gun assembly is operable with one of the plurality of perforation guns removed from the perforating gun assembly.

9. The assembly of claim 1, wherein diameters of the uphole plate and the downhole plate are sixteen inches.

10. The assembly of claim 1, wherein the plurality of perforation guns comprises at least six perforation guns.

11. The Perforating gun assembly of claim 1,
wherein
each of the plurality of perforation guns comprises:
a plurality of charges configured to punch holes in a casing within a wellbore; and
a housing configured to structurally support the perforating gun assembly and to house detonating cord within the perforator gun.

12. The assembly of claim 11, wherein the uphole plate comprises a detonator configured to detonate the charges of the plurality of perforation guns upon detonation, and the uphole plate is configured to receive a detonate signal from a wireline that instructs the detonator to detonate.

13. The assembly of claim 11, wherein the uphole plate comprises:
a plurality of legs configured to receive the plurality of perforation guns; and
a plurality of polymer alignment inserts, each of the plurality of polymer alignment inserts disposed within one of the plurality of legs and configured to orient a detonating cord within the uphole plate and a booster within the uphole plate with the detonating cord within one of the plurality of perforation guns.

14. A perforating gun assembly, comprising:
an uphole plate;
a downhole plate;
an interconnecting plate;
a first plurality of perforation guns coupled to the uphole plate and the interconnecting plate, wherein the first plurality of perforation guns comprise a first plurality of charges configured to punch holes in a casing within a wellbore; and
a second plurality of perforation guns coupled to the interconnecting plate and the downhole plate, wherein the second plurality of perforation guns comprise a second plurality of charges configured to punch holes in the casing within the wellbore
wherein each of the first plurality of perforation guns is removable from the perforating gun assembly, and wherein, when one perforation gun of the first plurality of perforation guns is removed from the perforating gun assembly, the perforating gun assembly comprises a pressure cap coupled to a leg of the uphole plate that is not filled by the one perforator gun.

15. The assembly of claim 14, wherein the interconnecting plate comprises a plurality of gun tandems configured to couple the first plurality of perforation guns to the second plurality of perforation guns.

16. The assembly of claim 14, wherein the interconnecting plate comprises a set of through holes configured to receive the first plurality of perforation guns and the second plurality of perforation guns.

17. The assembly of claim 14, wherein the uphole plate, the downhole plate, and the interconnecting plate each comprise at least on fluid hole configured to allow fluid within the wellbore to pass through the uphole plate, the downhole plate, and the interconnecting plate, and the at least one fluid hole of each of the uphole plate, the downhole plate, and the interconnecting plate align with each other in a vertical orientation.

18. The assembly of claim 14, wherein each perforation gun of the first plurality of perforation guns and the second plurality of perforation guns are removable from the perforating gun assembly and interchangeable with each other.

19. The assembly of claim 14, wherein each perforation gun of the first plurality of perforation guns and the second plurality of perforation guns comprises a housing configured to house a detonator cord of the perforator gun.

* * * * *